United States Patent [19]

Kellogg et al.

[11] Patent Number: 4,480,161

[45] Date of Patent: Oct. 30, 1984

[54] CIRCUIT BREAKER UTILIZING IMPROVED ARC CHAMBERS

[75] Inventors: Walter J. Kellogg, Black Mountain, N.C.; Allan V. Heberling, Daugherty Township, Beaver County, Pa.

[73] Assignee: Westinghouse Electric Corp., Pittsburgh, Pa.

[21] Appl. No.: 488,234

[22] Filed: Apr. 25, 1983

[51] Int. Cl.[3] ..... H01H 33/08

[52] U.S. Cl. ..... 200/144 R

[58] Field of Search ..... 200/144 R, 144 C, 147 R

[56] References Cited

U.S. PATENT DOCUMENTS

| | | | |
|---|---|---|---|
| 2,015,561 | 9/1935 | Jennings | 200/144 R |
| 2,020,935 | 11/1935 | Ellis et al. | 200/144 R |
| 4,393,287 | 7/1983 | Nakano | 200/147 R |

FOREIGN PATENT DOCUMENTS

| | | | |
|---|---|---|---|
| 767863 | 4/1954 | Fed. Rep. of Germany | 200/144 R |
| 1034742 | 7/1958 | Fed. Rep. of Germany | 200/144 R |
| 1217477 | 5/1966 | Fed. Rep. of Germany | 200/144 R |
| 733042 | 5/1980 | U.S.S.R. | 200/144 R |

*Primary Examiner*—Robert S. Macon

*Attorney, Agent, or Firm*—M. J. Moran

[57] ABSTRACT

A circuit breaker including an improved means of retaining an arc grid assembly within the arc grid assembly cavity defined by the housing of the circuit breaker. The means of retaining the arc grid assembly within the arc grid assembly cavity is the arc grid assembly has a framework formed of a rigid material that may be temporarily plasticized and is inserted within the arc grid assembly cavity while it is in the temporarily plasticized state, wherein said framework rigid material hardens and is retained by restraining means such as lugs which are placed upon the housing of the circuit breaker which defines the arc grid assembly cavity.

16 Claims, 2 Drawing Figures

CIRCUIT BREAKER UTILIZING IMPROVED ARC CHAMBERS

BACKGROUND OF THE INVENTION

1. Field of the Invention

The invention relates in general to single or multi-pole circuit breakers, and more particularly, to circuit breakers having an improved means of retaining their arc grid assemblies in the arc grid assembly cavity within the framework or housing of the circuit breaker.

2. Description of the Prior Art

The basic functions of circuit breakers are to provide electrical system protection and coordination whenever abnormalities occur on any part of the system. The operating voltage, continuous current, frequency, short circuit interrupting capability, and time-current coordination needed are some of the factors which must be considered when designing a breaker. Government and industry are placing increasing demands upon the electrical industry for interrupters with improved performance in a smaller package and with numerous new and novel features.

Stored energy mechanisms for use in circuit breakers of the single pole or multi-pole type have been known in the art. A particular construction of such mechanisms is primarily dependent upon the parameters such as rating of the breaker. An example of an arc chamber assembly is found in U.S. Pat. No. 4,229,630 to John A. Wafer and Alfred E. Maier, assigned to the same assignee as the present invention, hereby referred to and incorporated herein.

Circuit breakers and other equipment employing arc grid assemblies require a means for retaining these assemblies in position within a cavity provided for them within the framework or housing of the circuit breaker. In the prior art, means for retaining the arc grid assemblies within their cavities include retaining springs, screws and other fastening means such as glue. The disadvantages of these means of retaining the assemblies employed by the prior art is economic (the cost of the mechanical retaining means employed) as well as the fact that these retaining means are subject to failure. Accordingly, it would be desirable to provide a secure, reliable assembly of the arc grid assemblies within the housing or framework of the circuit breaker (within the cavity provided for the arc grid assembly within the framework of the circuit breaker) without the use of glue, screws, springs and other mechanical retaining means.

SUMMARY OF THE INVENTION

Briefly, the present invention comprises a circuit breaker provided with stationary and movable contacts operable between open and closed positions with respect to the stationary contact, disposed within a housing, a movable arcing contact movable with the movable contacts between the open and closed positions, movement effecting means for effecting movement of the movable and arcing contacts between the open and closed positions, an arc grid assembly having a framework formed of a rigid material that may be temporarily plasticized and an arc grid assembly cavity defined by a portion of the housing having restraining means disposed to interfere with the rigid arc grid assembly frame should the frame be acted upon by forces tending to expel the frame from the cavity. The arc grid assembly is disposed within the arc grid assembly cavity when the arc grid assembly framework is in the temporary plasticized state.

The circuit breaker according to the teachings of the invention provides a secure, reliable means and method of assembling the arc grid assemblies within their respective cavities in the housing or framework of the circuit breaker without the use of glue, screws or springs, with the advantages of the cost and maintenance savings of eliminating the extra retaining means.

BRIEF DESCRIPTION OF THE DRAWINGS

The invention may be understood, and further advantages and uses thereof more readily apparent, when considered in view of the following detailed description of exemplary embodiments, taken with the accompanying drawings, in which.

DESCRIPTION OF THE PREFERRED EMBODIMENTS

Figure 1:
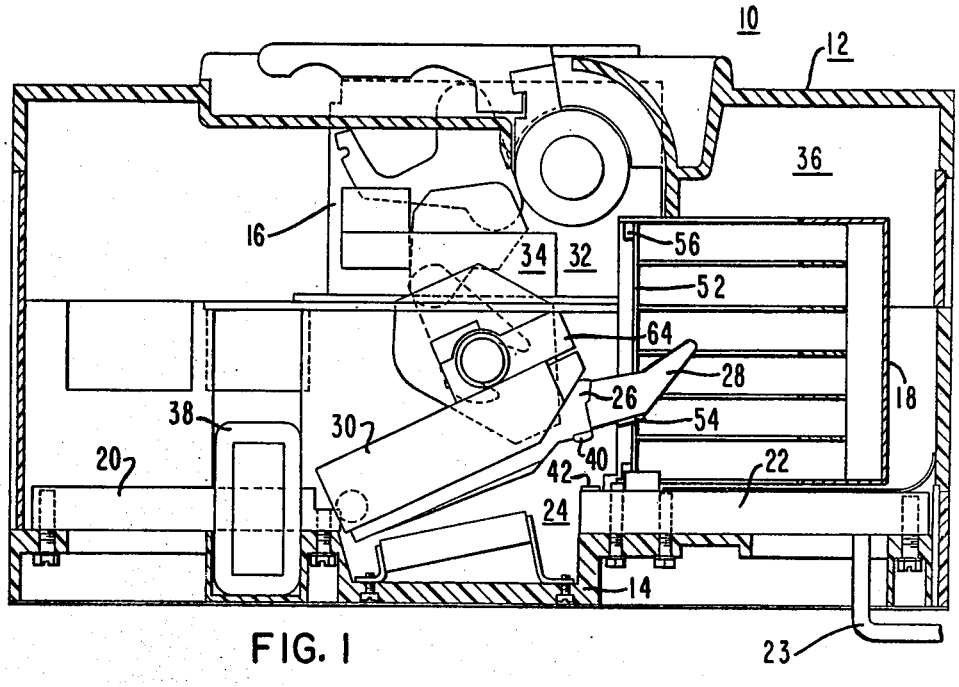
FIG. 1 is an elevational, sectional view of a circuit breaker constructed according to the teachings of the invention.

Referring now more particularly to FIG. 1, there is shown a circuit breaker utilizing the teachings of this invention. Circuit breaker 10 includes support 12 which is comprised of a mounting base 14, side walls 16, support walls 13, 15 and a frame structure 18. The mounting base 14 and support walls 13, 15 are, in the preferred embodiment, molded of an electrically insulating material such as plastic. A pair of stationary contacts 20, 22 are disposed within the support 12, with the support walls 13, 15 disposed between adjacent pairs of stationary contacts 20, 22. Stationary contact 22 would, for example, be connected to an incoming power line 23, while the other stationary contact 20 would be connected to the load (not shown). Electrically connecting the two stationary contacts 20, 22 is a movable contact structure 24. The movable contact structure 24 comprises a movable contact 26, a movable arcing contact 28, a contact carrier 30 and a crossbar insulator 64. The movable contact 26 and the arcing contact 28 are pivotally secured to the stationary contact 20, and are capable of being in open and closed positions with respect to the stationary contact 22. Throughout this application, the term "open" as used with respect to the contact position means that the movable contacts 26, 28 are spaced apart from the stationary contact 22, whereas the term "closed" indicates the position wherein the movable contacts 26, 28 are contacting both stationary contacts 22 and 20. The movable contacts 26, 28 are mounted to and carried by the contact carrier 30 and crossbar insulator 64.

Also included within the circuit breaker 10 is an operating mechanism 32, a toggle means 34, and an arc chamber 36 which extinguishes any arc which may be present when the movable contacts 26, 28 change from the closed to open position. A current transformer 38 is utilized to monitor the amount of current flowing through the stationary contact 20.

Figure 2:
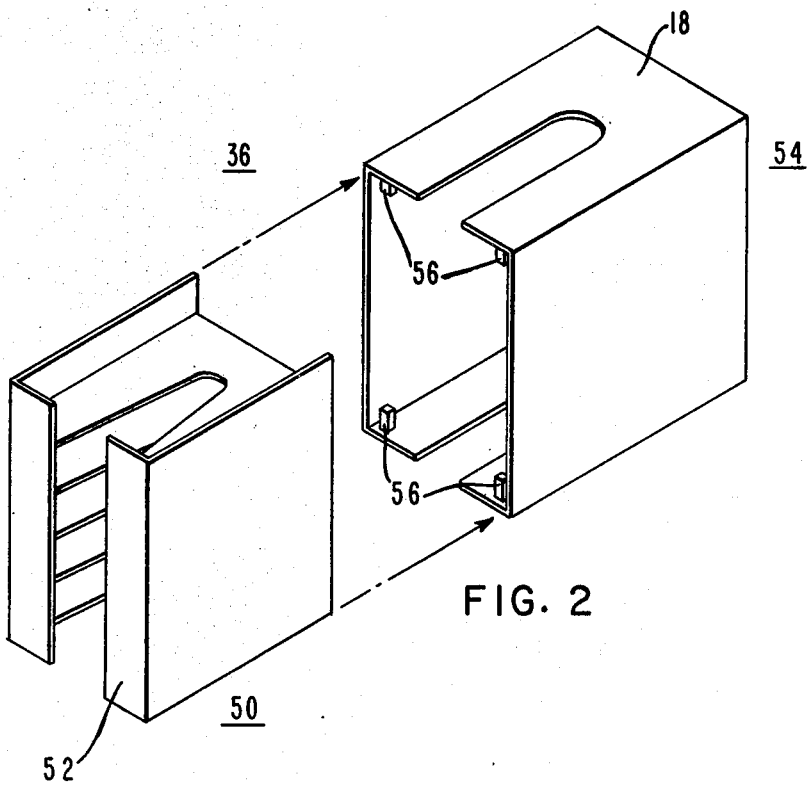
FIG. 2 is an enlarged elevational view of the arc chamber of the circuit breaker illustrated in FIG. 1 including an arc grid assembly and a complementary arc grid assembly cavity defined by the housing or framework of the circuit breaker.

Referring now to FIG. 2, there is shown an enlarged elevational view of the arc chamber 36 including an arc grid assembly 50 having a framework 52 formed of a rigid material that may be temporarily plasticized, such as for example fish paper, and arc grid assembly cavity 54 defined by a portion of frame or housing 18 of circuit breaker 10. Restraining means 56 which may, for example, be the four retaining lugs shown, is disposed on housing 18 to interfere with rigid arc grid assembly framework 52 should the rigid arc grid assembly framework 52 be acted upon by forces tending to expel the arc grid assembly framework 52 from cavity 54.

Arc grid assembly 50 including arc grid assembly framework 52 is disposed within arc grid assembly cavity 54 when arc grid assembly framework 52 is in the temporarily plasticized state which may be brought about, for example, by soaking the fish paper framework in water about two hours until it is pliable and then inserting it into the cavity. The soft, presoaked fish paper folds easily over the four retaining lugs 56. After it is dried, the fish paper again hardens and securely retains the arc grid assembly 50 within the arc grid assembly cavity 54. The advantages of this arrangement are that there are no screws, springs or glue to fail, plus the cost savings of eliminating these extra retaining means.

It is to be understood that other means of inserting a rigid framework material that may be temporarily plasticized are within the teachings of the invention. For example, the rigid frame material may be a thermoset resin or thermoplastic resin or a chemical set resin by the addition of a hardener, the fish paper of the preferred embodiment, or any other temporarily plasticizable material that may be inserted within the arc grid assembly cavity and then become rigid.

Although the preferred embodiment of a circuit breaker was described, the invention is broadly applicable to safety switches, disconnect switches and motor starters as well as other electrical apparatus when it is desirable to retain an arc grid within an arc grid cavity defined by the housing of the electrical apparatus.

What is claimed is:

1. A circuit breaker, comprising:

(a) first and second spaced apart stationary contacts disposed within a housing;

(b) a movable contact disposed within said housing and operable between electrically open and closed positions with respect to said stationary contacts;

(c) a movable arcing contact disposed within said housing and operable between electrically open and closed positions with respect to said stationary contacts;

(d) movement effecting means for effecting movement of said movable and arcing contacts between said open and closed positions;

(e) an arc grid assembly having a framework formed of a rigid material that may be temporarily plasticized; and (f) an arc grid assembly cavity defined by a portion of said housing having restraining means disposed to interfere with said rigid arc grid assembly frame, should said frame be acted upon by forces tending to expel said frame from said cavity, said arc grid assembly being disposed within said cavity when said framework is in the temporary plasticized state.

2. The circuit breaker of claim 1 wherein the restraining means are rigid projections disposed upon the periphery of the portion of the housing defining the arc grid assembly cavity at a position through which the arc grid assembly frame must be moved while in the plasticized state in the assembly of the circuit breaker.

3. The circuit breaker of claim 2 wherein the arc grid assembly framework plasticizable material includes a thermoset resin.

4. The circuit breaker of claim 2 wherein the arc grid assembly framework plasticizable material includes a thermoplastic resin.

5. The circuit breaker of claim 2 wherein the arc grid assembly framework plasticizable material includes a chemical set resin.

6. The circuit breaker of claim 2 wherein the arc grid assembly framework plasticizable material includes a rigid material that may be temporarily plasticized by the addition of a solvent.

7. The circuit breaker according to claim 6 wherein the plasticizable frame of the arc grid assembly is made of fish paper.

8. The circuit breaker of claim 3 wherein the plasticizable frame of the arc grid assembly is fish paper side walls supporting an arc grid assembly and the rigid projections of the restraining means are four restraining lugs, one restraining lug disposed at each corner of the face of the arc grid assembly cavity.

9. Electrical apparatus, comprising:

a housing;

an arc grid assembly having a framework formed of a rigid material that may be temporarily plasticized; and an arc grid assembly cavity defined by a portion of said housing having restraining means disposed to interfere with said rigid arc grid assembly frame, should said frame be acted upon by forces tending to expel said frame from said cavity, said arc grid assembly being disposed within said cavity when said framework is in the temporary plasticized state.

10. The electrical apparatus of claim 9 wherein the restraining means are rigid projections disposed upon the periphery of the portion of the housing defining the arc grid assembly cavity at a position through which the arc grid assembly frame must be moved while in the plasticized state in the assembly of the circuit breaker.

11. The electrical apparatus of claim 10 wherein the arc grid assembly framework plasticizable material includes a thermoset resin.

12. The electrical apparatus of claim 10 wherein the arc grid assembly framework plasticizable material includes a thermoplastic resin.

13. The electrical apparatus of claim 10 wherein the arc grid assembly framework plasticizable material includes a chemical set resin.

14. The electrical apparatus of claim 10 wherein the arc grid assembly framework plasticizable material includes a rigid material that may be temporarily plasticized by the addition of a solvent.

15. The electrical apparatus of to claim 10 wherein the plasticizable frame of the arc grid assembly is made of fish paper.

16. The electrical apparatus of claim 10 wherein the plasticizable frame of the arc grid assembly is fish paper side walls supporting an arc grid assembly and the rigid projections of the restraining means are four restraining lugs, one restraining lug disposed at each corner of the face of the arc grid assembly cavity.

* * * * *